US010287120B2

(12) United States Patent
Imoto et al.

(10) Patent No.: US 10,287,120 B2
(45) Date of Patent: May 14, 2019

(54) DOCUMENT FEEDER AND IMAGE FORMING DEVICE

(71) Applicant: KONICA MINOLTA, INC., Chiyoda-ku, Tokyo (JP)

(72) Inventors: Tomiko Imoto, Toyohashi (JP); Katsuhisa Ichikawa, Chiryu (JP); Syuichi Katogi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/936,355

(22) Filed: Mar. 26, 2018

(65) Prior Publication Data

US 2018/0334344 A1 Nov. 22, 2018

(30) Foreign Application Priority Data

May 18, 2017 (JP) ..... 2017-099297

(51) Int. Cl.

| | |
|---|---|
| ***B65H 5/36*** | (2006.01) |
| ***B65H 5/38*** | (2006.01) |
| ***B65H 7/02*** | (2006.01) |
| ***B65H 7/18*** | (2006.01) |
| ***B65H 3/06*** | (2006.01) |

(Continued)

(52) U.S. Cl.

CPC ..... *B65H 7/18* (2013.01); *B65H 3/06* (2013.01); *B65H 5/06* (2013.01); *B65H 5/062* (2013.01); *B65H 5/34* (2013.01); *B65H 5/36* (2013.01); *B65H 7/02* (2013.01); *B65H 7/04* (2013.01)

(58) Field of Classification Search

CPC ... B65H 7/02; B65H 7/14; B65H 7/18; B65H 7/20; B65H 5/06; B65H 5/062; B65H 5/36; B65H 5/34; B65H 3/06; B65H 3/66; B65H 2301/4452; B65H 2701/1311; B65H 2701/1313

See application file for complete search history.

(56) References Cited

U.S. PATENT DOCUMENTS

| | | | | |
|---|---|---|---|---|
| 6,409,043 | B1 * | 6/2002 | Fujita | B65H 5/24 271/10.03 |
| 9,422,128 | B2 * | 8/2016 | Kaiga | B65H 7/02 |
| 9,575,453 | B1 * | 2/2017 | Boyatt, III | G03G 15/2064 |

FOREIGN PATENT DOCUMENTS

| | | | |
|---|---|---|---|
| JP | 2010156771 A | | 7/2010 |
| JP | 2010173763 A | * | 8/2010 |

(Continued)

*Primary Examiner* — Luis A Gonzalez
(74) *Attorney, Agent, or Firm* — Holtz, Holtz & Volek PC

(57) ABSTRACT

A document feeder includes: a first conveyer that picks up sheets from a sheet bundle sheet by sheet, where rear edge of a preceding sheet overlaps front edge of a succeeding sheet; a second conveyer that conveys each sheet picked up by the first conveyer; a front edge sensor that is disposed on a conveyance path from the first conveyer to the second conveyer, and senses whether the sheet falls within a sensing range; and a shift unit that shifts, while the first and second conveyers convey the sheet, positional relation between the sheet and the front edge sensor by increasing distance therebetween in a direction crossing a sheet conveyance direction, such that the sheet falls outside the sensing range. When the preceding sheet falls outside the sensing range, the first conveyer picks up the succeeding sheet such that the front edge of the succeeding sheet enters the sensing range.

12 Claims, 18 Drawing Sheets

(51) Int. Cl.

| | |
|---|---|
| ***B65H 7/04*** | (2006.01) |
| ***B65H 5/06*** | (2006.01) |
| ***B65H 5/34*** | (2006.01) |

(56) References Cited

FOREIGN PATENT DOCUMENTS

| | | | | |
|---|---|---|---|---|
| JP | 2012131610 | A | * | 7/2012 |
| JP | 2014084222 | A | | 5/2014 |

* cited by examiner

Side view (standby)

Side view (sensing)

External perspective view

Standby

Sensing

Retraction

Standby

Cross-sectional view (standby)

Cross-sectional view (retraction)

Swinging of conveyance guide 210

Sensing of preceding sheet

Retraction of front edge sensor

Sensing of succeeding sheet

Cancellation of retraction

Sensing of preceding sheet

Reach by preceding sheet

Retraction of preceding sheet

Sensing of succeeding sheet

Cancellation of retraction

DOCUMENT FEEDER AND IMAGE FORMING DEVICE

The entire disclosure of Japanese patent Application No. 2017-099297, filed on May 18, 2017, is incorporated herein by reference in its entirety.

BACKGROUND

(1) Technological Field

The present invention relates to a document feeder and an image forming device. In particular, the present invention relates to improvement of an art of conveying sheets sheet by sheet with the rear edge of a preceding sheet overlapping the front edge of a succeeding sheet, thus improving the productivity.

(2) Description of the Related Art

In an image forming device, sheets housed in a paper cassette are separated sheet by sheet and fed, and then each sheet is conveyed to an image forming unit for image formation.

A sheet conveyance speed varies for various causes during conveyance from the paper cassette to the image forming unit. Due to this, in the case where sheet feeding is performed with excessively short intervals between a preceding sheet and a succeeding sheet, the front edge of the succeeding sheet comes up with the rear edge of the preceding sheet on a conveyance path and thus the preceding sheet overlaps the succeeding sheet. This might cause failure in image formation and paper jam. Meanwhile, sheet feeding with increased sheet intervals decreases the number of sheets on which image formation is to be performed per time unit, and thus deteriorates the productivity.

In response to such a problem, the following recording device has been for example proposed (see Japanese Patent Application Publication No. 2014-084222). According to this recording device, a preceding sheet and a succeeding sheet are fed from a paper cassette while the rear edge of the preceding sheet overlaps the front edge of the succeeding sheet. When the front edge of the succeeding sheet is sensed upstream of an image forming unit on a conveyance path, conveyance of the succeeding sheet stops while conveyance of the preceding sheet continues. Then, when the rear edge of the preceding sheet passes through the front edge of the succeeding sheet, conveyance of the succeeding sheet restarts.

This configuration allows a precise control on the sheet intervals between the preceding sheet and the succeeding sheet, thus improving the productivity even with variation in conveyance speed.

According to the above conventional art, unfortunately, an optical sensor such as light emitting diodes and phototransistor are used to sense the front edge of the succeeding sheet with the preceding sheet and the succeeding sheet overlapping one another. This inevitably increases component costs. Moreover, in the case where heavy paper is used as sheets, transmitted light is insufficiently obtained, and this disables sensing of the front edge of the succeeding sheet. As a result, the preceding sheet and the succeeding sheet are conveyed to an image forming unit while overlapping one another, and thus a failure inevitably occurs.

SUMMARY

The present invention was made in view of the above problems, and aims to provide a document feeder and an image forming device that achieve a higher productivity with lower costs than conventional ones.

In order to achieve the above aim, the document feeder relating to at least one aspect of the present invention is a document feeder including: a first conveyer that picks up sheets from a sheet bundle sheet by sheet, where a rear edge of a preceding sheet overlaps a front edge of a succeeding sheet; a second conveyer that conveys each sheet picked up by the first conveyer; a front edge sensor that is disposed on a conveyance path from the first conveyer to the second conveyer, and senses whether the sheet falls within a sensing range; and a shift unit that shifts, while the first conveyer and the second conveyer convey the sheet, a positional relation between the sheet and the front edge sensor by increasing a distance therebetween in a direction crossing a sheet conveyance direction, such that the sheet falls outside the sensing range of the front edge sensor, wherein when the preceding sheet falls outside the sensing range, the first conveyer picks up the succeeding sheet such that the front edge of the succeeding sheet enters the sensing range.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the invention.

In the drawings.

DETAILED DESCRIPTION OF EMBODIMENTS

Hereinafter, one or more embodiments of the present invention will be described with reference to the drawings. However, the scope of the invention is not limited to the disclosed embodiments.

[1] First Embodiment

In a document feeder and an image forming device relating to a first embodiment of the preset invention, an actuator type photo sensor, which is less expensive than an optical sensor, is used as a sensor for sensing the front edge of each sheet, in order to reduce component costs. Also, to enable such an actuator type photo sensor to sense the front edge of a succeeding sheet, sheet feeding is performed with the rear edge of a preceding sheet overlapping the front edge of the subsequent sheet, and then the preceding sheet is retracted to fall outside a sensing range for the front edge of each sheet.

(1-1) Configuration of Image Forming Device

The following describes the configuration of an image forming device relating to the present embodiment.

Figure 1:
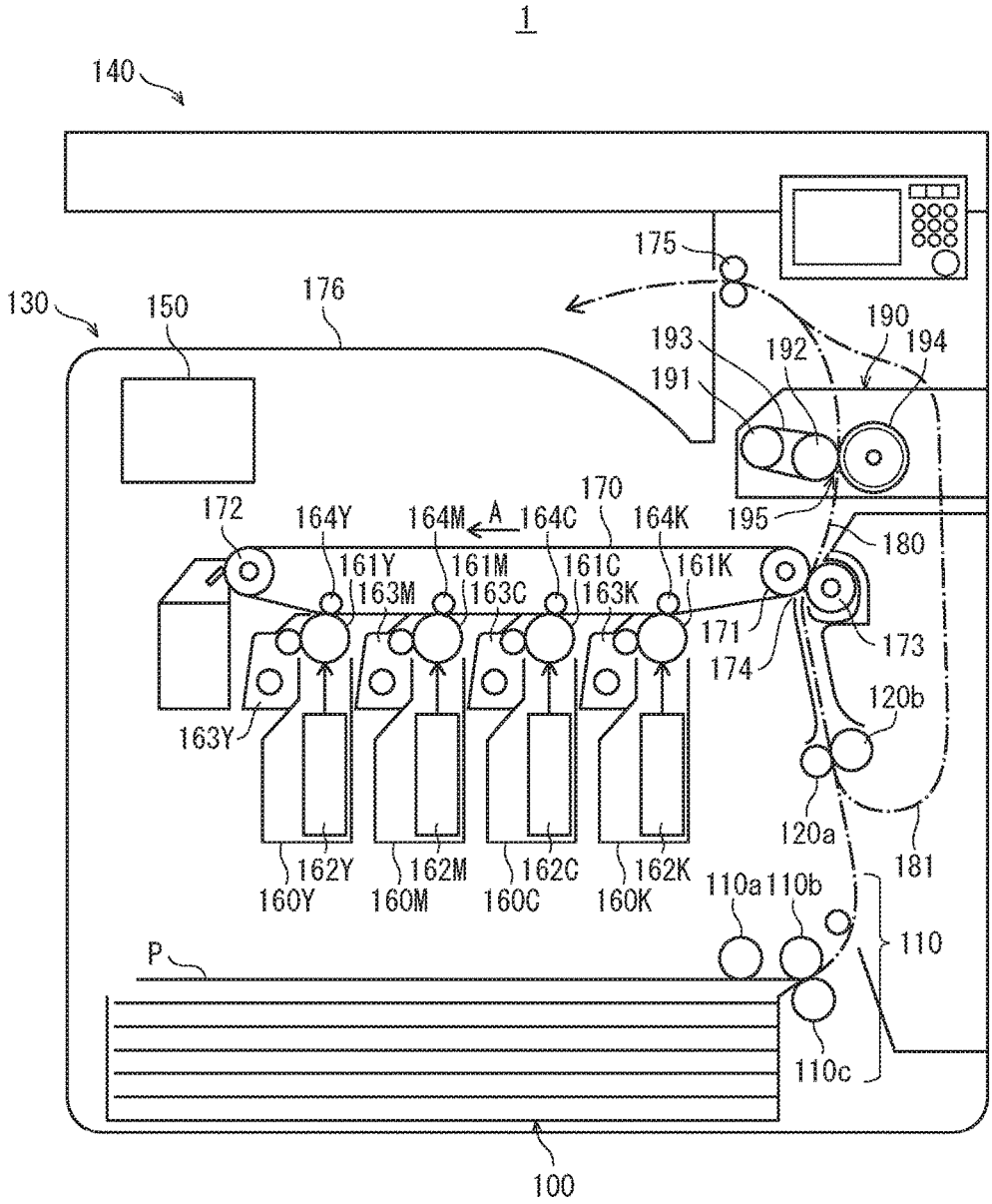
FIG. 1 shows major components of an image forming device relating to a first embodiment of the present invention.

As shown in FIG. 1, an image forming device 1 is a so-called tandem-type color multi-function peripheral (MFP), and includes a body 130 that forms images according to an electronic photography system and a scanner 140 that scans images from documents.

The scanner 140 scans images from documents, which are placed on a platen glass or conveyed by an automatic document feeder (ADF), to generate digital image data (though its configuration is not illustrated in detail). The generated digital image data is stored in a controller 150. The scanner 140 may be a color scanner or a monochrome scanner.

The body 130 includes the controller 150 that controls operations of units included in the body 130, and further includes imaging units 160Y, 160M, 160C, and 160K that form toner images of yellow (Y), magenta (M), cyan (C), and black (K) colors under control by the controller 150. The imaging units 160Y, 160M, 160C, and 160K respectively include photosensitive drums 161Y, 161M, 161C, and 161K, exposure devices 162Y, 162M, 162C, and 162K, and developing devices 163Y, 163M, 163C, and 163K, and so on. The imaging units 160Y, 160M, 160C, and 160K further each include a charging device and a cleaning device, which are not illustrated.

The imaging units 160Y, 160M, 160C, and 160K each use the charging device (not illustrated) to respectively perform uniform charging on outer circumferential surfaces of the photosensitive drums 161Y, 161M, 161C, and 161K. The exposure devices 162Y, 162M, 162C, and 162K respectively expose the outer circumferential surfaces of the photosensitive drums 161Y, 161M, 161C, and 161K to form electrostatic latent images. The developing devices 163Y, 163M, 163C, and 163K respectively supply Y, M, C, and K toners to develop the electrostatic latent images to form Y, M, C, and K toner images.

Primary transfer rollers 164Y, 164M, 164C, and 164K respectively electrostatically transfer the Y, M, C, and K toner images thus formed onto an outer circumferential surface of an intermediate transfer belt 170 such that the toner images overlap one another (primary transfer). As a result, a color toner image is formed. For this reason, a primary transfer bias voltage is applied to the primary transfer rollers 164Y, 164M, 164C, and 164K.

The intermediate transfer belt 170 is tensioned by a drive roller 171 and a driven roller 172, and is driven by the drive roller 171 to rotate in a direction indicated by an arrow A. The intermediate transfer belt 170 rotates to convey the color toner image to a secondary transfer nip 174 formed between the drive roller 171 and a secondary transfer roller 173.

The body 130 has a paper cassette 100 in a lower part thereof. The paper cassette 100 stores therein sheets P which are stacked. A first conveyer 110, which is constituted from conveyance rollers 110*a*, 110*b*, and 110*c*, picks up the sheets P sheet by sheet from the paper cassette 100 to a conveyance path 180. Timing rollers 120*a* and 120*b* adjust a conveyance timing of each of the sheets P. Then, the sheet P is conveyed to the secondary transfer nip 174.

A secondary transfer bias voltage is applied between the drive roller 171 and the secondary transfer roller 173. The color toner image is electrostatically transferred onto the sheet P at the secondary transfer nip 174 (secondary transfer).

Then, the sheet P is conveyed to a fusing unit 190 on the conveyance path 180. The fusing unit 190 includes an endless heating belt 193 that is tensioned between a heating roller 191 and a fusing roller 192. The fusing roller 192 is in pressure-contact with a pressure roller 194 via the heating belt 193 to form a fusing nip 195 therebetween. The sheet P is fed through the fusing nip 195 and thus the toner image is thermally fused onto the sheet P.

The sheet P, onto which the toner image has been thermally fused, is ejected to an ejection tray 176 by ejection rollers 175. In order to form images on the back side of the sheet P as well, the ejection rollers 175 does not eject the sheet P to the ejection tray 176 but switches back the sheet P to send out the sheet P to a circular conveyance path 181. The sheet P, which is reversed, is conveyed on the circular conveyance path 181 to the timing rollers 120*a* and 120*b* for adjustment of its conveyance timing. Then, images are formed on the back side of the sheet P in the same manner as image formation on the front side of the sheet P.

(1-2) Configuration of First Conveyer 110 and Front Edge Sensor

The following describes configuration of a front edge sensor that senses the front edge of each sheet fed from the paper cassette 100.

Figure 2:
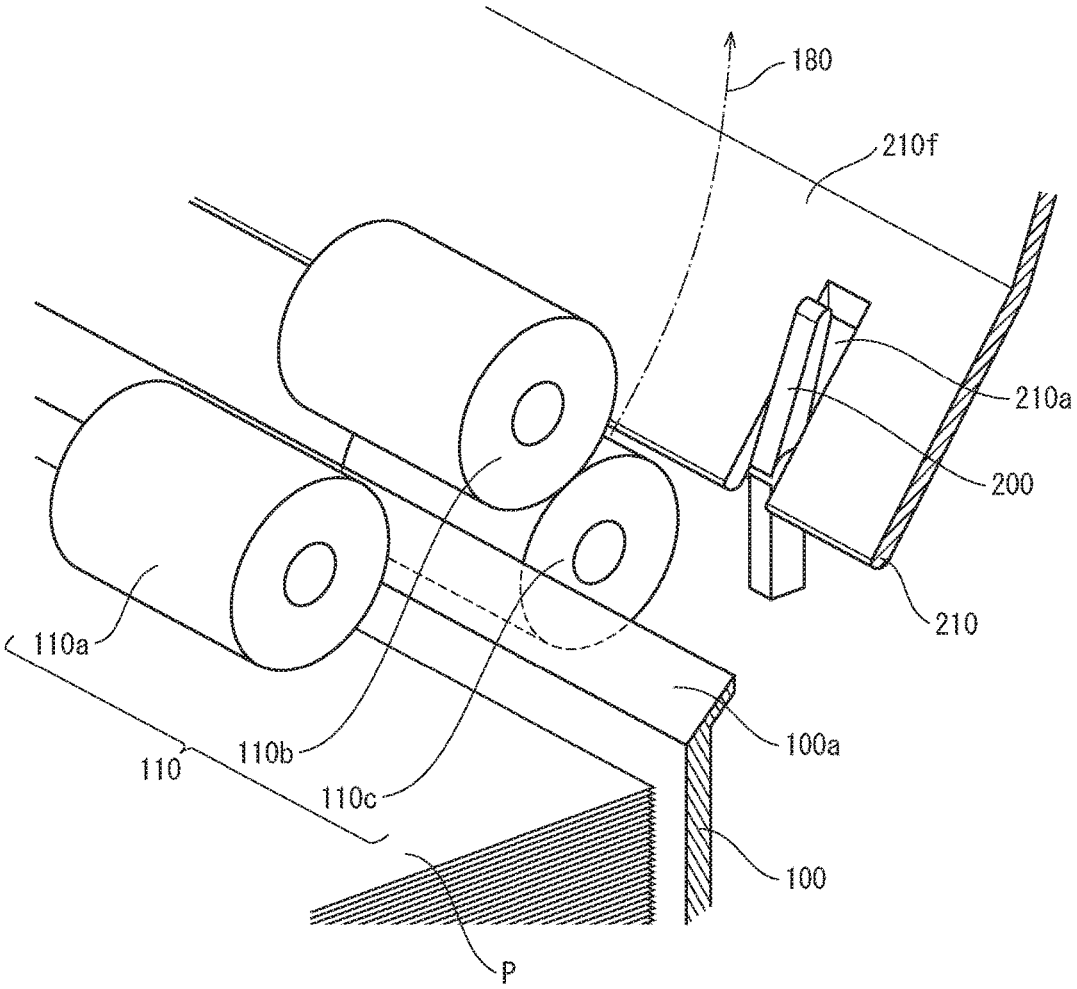
FIG. 2 is a cross-sectional perspective view of a first conveyer and a front edge sensor relating to the first embodiment.

As shown in FIG. 2, sheets P stored in the paper cassette 100 are picked up by the conveyance roller 110*a* (pickup roller) sheet by sheet, and are sent out by the conveyance rollers 110*b* and 110*c* to the conveyance path 180. The sheets P, which are picked the conveyance path 180, are each guided by a conveyance guide 210 to the timing rollers 120*a* and 120*b* (see FIG. 1).

As shown in FIG. 2, the conveyance guide 210 has a cutout 210*a*. In a standby state where an actuator 200 is in out of contact with the sheet P, the tip end of the actuator 200 protrudes through the cutout 210*a* from a guide surface 210*f* of the conveyance guide 210 towards the conveyance path 180.

Figure 3A:
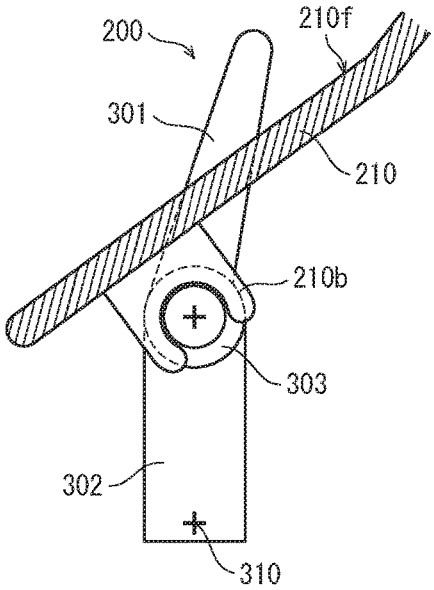
FIG. 3A is a side view of an actuator 200 during standby.

As shown in FIG. 3A, the actuator 200 includes an arm part 301, a light shielding part 302, and a cylindrical shaft 303 that are integrally formed together. The arm part 301 and the light shielding part 302 protrude from the cylindrical shaft 303 in substantially opposite directions to each other. The cylindrical shaft 303 is rotatably supported by a bearing 210*b* protruding from a side of the conveyance guide 210 opposite to the guide surface 210*f*. As shown in FIG. 3C, the cylindrical shaft 303 rotates in directions indicated by arrows D (clockwise and counterclockwise directions).

While the arm part 301 is not pushed down by the sheet P (the standby state), the actuator 200 is in a standby orientation where the tip end of the arm part 301 protrudes from the guide surface 210*f* by gravity. As shown in FIG. 3C, the image forming device 1 includes light emitting elements 311 and photoreceptors 312. In the standby state where the actuator 200 is in the standby orientation, the light shielding part 302 shields sensing light at a passing position 310 where the sensing light reaches from the light emitting elements 311 to the photoreceptors 312. Due to this, the photoreceptors 312 do not sense the sensing light.

Figure 3B:
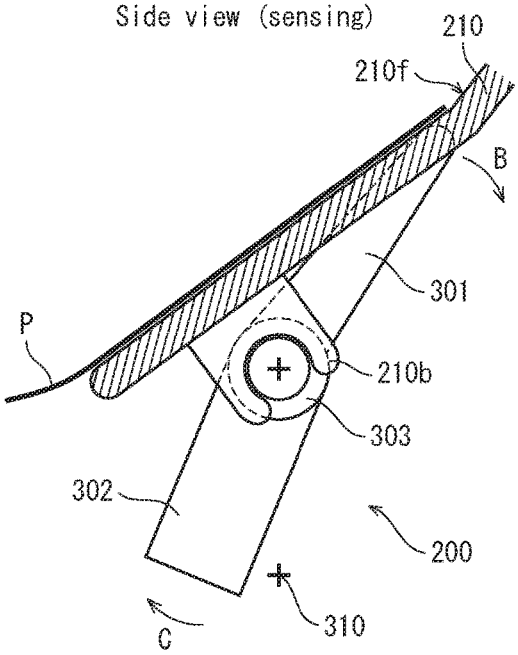
FIG. 3B is a side view of the actuator 200 during sensing.
Figure 3C:
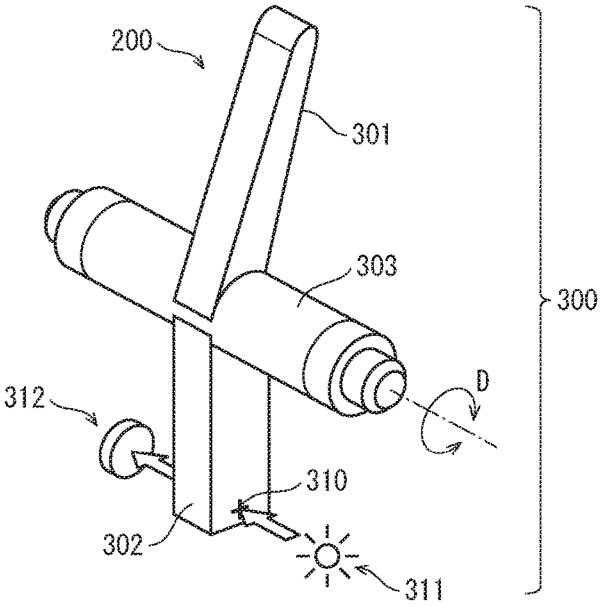
FIG. 3C is an external perspective view of the actuator 200.

Meanwhile, when the arm part 301 is pushed down by the front edge of the sheet P which is being conveyed by the conveyance guide 210, the arm part 301 swings in a direction indicated by an arrow B and the light shielding part 302 swings in a direction indicated by an arrow C as shown in FIG. 3B. As a result, the actuator 200 changes to a sensing orientation where the light shielding part 302 deviates from the passing position 310 for sensing light. Accordingly, the photoreceptors 312 sense the sensing light and input a sensing signal to the controller 150. A pass time of the front edge of the sheet P is sensed in this manner.

(1-3) Feeding Operations

The following describes feeding operations, performed by the image forming device 1, of conveying the preceding sheet P1 and the succeeding sheet P2 while overlapping the rear edge of the preceding sheet P1 and the front edge of the succeeding sheet P2.

As shown in FIGS. 4A to 4D, the first conveyer 110, the actuator 200 of a front edge sensor 300, the conveyance guides 210, 401, and 403, and a guide roller 402 are provided on a conveyance path for sheets P from the paper cassette 100 to a second conveyer 120. The first conveyer 110 is constituted from the conveyance rollers 110*a*, 110*b*, and 110*c*, and the second conveyer 120 is constituted from the timing rollers 120*a* and 120*b*.

Of these conveyance rollers and timing rollers, the conveyance rollers 110*a* and 110*c* are driven by a feeding motor (not illustrated) to rotate, and the conveyance roller 110*b* and the timing rollers 120*a* and 120*b* are driven by a conveyance roller (not illustrated) to rotate. Also, a conveyance force F1 of the first conveyer 110 is lower than a conveyance force F2 of the second conveyer 120 as shown in Math (1) below.

$$F1<F2 \quad (1)$$

Furthermore, a conveyance speed V1 of the first conveyer 110 is lower than a conveyance speed V2 of the second conveyer 120 as shown in Math (2) below.

$$V1<V2 \quad (2)$$

Moreover, the first conveyer 110 and the second conveyer 120 are disposed such that a conveyance direction of the conveyance rollers 110*b* and 110*c*, which are included in the first conveyer 110, differs from a conveyance direction of the timing rollers 120*a* and 120*b*, which constitute the second conveyer 120. Also, the front edge sensor 300 for sensing the front edge of each sheet is disposed on a part from the first conveyer 110 to the second conveyer 120 on the conveyance path 180.

Figure 4A:
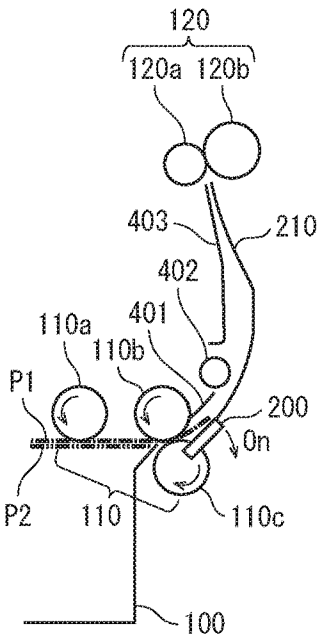
FIGS. 4A to 4D each exemplify a preceding sheet P1 and a succeeding sheet P2 that are conveyed on a conveyance path from a paper cassette 100 to a second conveyer 120.

To consecutively feed two sheets P1 and P2, the conveyance roller 110*a* picks up the sheet P1, which is the top of a sheet bundle placed on the paper cassette 100 (hereinafter, referred to as the preceding sheet P1), and the conveyance rollers 110*b* and 110*c* feed the preceding sheet P1 to the conveyance path 180. Then, the fed preceding sheet P1 pushes down the actuator 200, and the actuator 200 accordingly swings to change from the standby orientation to the sensing orientation. This allows the front edge sensor 300 to sense the front edge of the preceding sheet P1 to input a sensing signal to the controller 150 (FIG. 4A).

Figure 4B:
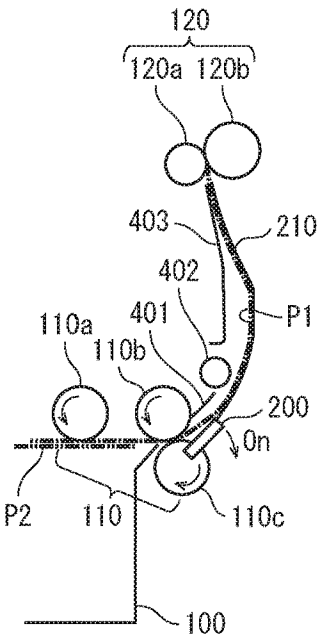

The conveyance guide 210 is provided on an extension of the conveyance direction of the first conveyer 110. When the preceding sheet P1 is caught between the conveyance rollers 110*b* and 110*c* of the first conveyer 110, the preceding sheet P1 is pressed against the conveyance guide 210 by the action of its rigidity and thus is conveyed along the conveyance guide 210 to the second conveyer 120 (FIG. 4B).

Figure 4C:
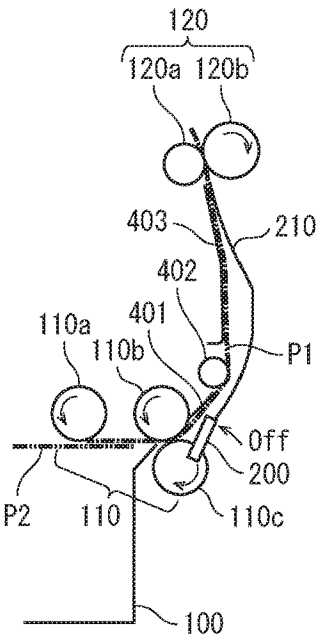

When the front edge of the preceding sheet P1 is caught between the timing rollers 120*a* and 120*b*, which constitute the second conveyer 120, the preceding sheet P1 is pulled by the second conveyer 120 because the second conveyer 120 is higher in conveyance speed than the first conveyer 110. As a result, the preceding sheet P1 floats up from the front side of the conveyance guide 210, and is conveyed while deforming along the conveyance guides 401 and 403 and the guide rollers 402 as shown in FIG. 4C. Thus, the preceding sheet P1 retracts to fall outside a swinging range of the actuator 200 (a sensing range of the front edge sensor 300), and the actuator 200 returns from the sensing orientation to the standby orientation (FIG. 4C).

Then, the rear edge of the preceding sheet P1 passes through the conveyance roller 110*a* of the first conveyer 110. Simultaneously with this, the succeeding sheet P2 travels straight with the front edge thereof pressed against the conveyance guide 210 by the action of its rigidity, and is conveyed by the conveyance roller 110*a* (see FIG. 4D). In this case, conveyance of the succeeding sheet P2 starts before the rear edge of the preceding sheet P1 passes through a conveyance nip between the conveyance rollers 110*b* and 110*c*. This is because the conveyance roller 110*a* is disposed closer to the rear edge than to the front edge of sheets stored in the paper cassette 100 in the conveyance direction. Accordingly, the preceding sheet P1 and the succeeding sheet P2 are conveyed while the rear edge of the preceding sheet P1 overlaps the front edge of the succeeding sheet P2.

Figure 4D:
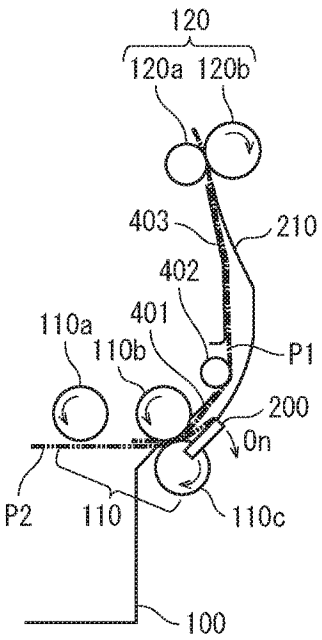

As described above, while the preceding sheet P1 retracts to fall outside the swinging range of the actuator 200, the succeeding sheet P2, which is caught between the conveyance rollers 110*b* and 110*c* of the first conveyer 110, is pressed against the conveyance guide 210 by the action of its rigidity and is conveyed along the conveyance guide 210. Then, the succeeding sheet P2 enters the swinging range of the actuator 200 to push down the actuator 200, and the actuator 200 accordingly swings to change from the standby orientation to the sensing orientation. Thus, the front edge sensor 300 senses the front edge of the succeeding sheet P2 to input a sensing signal to the controller 150 (FIG. 4D).

In the case of conveyance of sheets after the succeeding sheet P2, the front edge of each sheet is sensed in the same manner.

With this configuration, the use of the actuator 200, which is less expensive than optical sensors, suppresses costs, and a precise sensing of the front edges of sheets improves the productivity.

Note that the conveyance rollers 110*a*, 110*b*, and 110*c*, which constitute the first conveyer 110, each may be a pickup roller, a feed roller, or a separation roller. Also, the above description has been provided taking an example where the first conveyer 110 is constituted from three rollers. Alternatively, the number of rollers constituting the first conveyer 110 may be arbitrary. The timing rollers 120*a* and 120*b*, which constitute the second conveyer 120, may be conveyance rollers. The first conveyer 110 and the second conveyer 120 each may have any configuration as long as the preceding sheet P1 retracts to fall outside the swinging range of the actuator 200 before the succeeding sheet P2 pushes down and swings the actuator 200.

(1-4) Controller 150

The following describes the controller 150.

Figure 5:
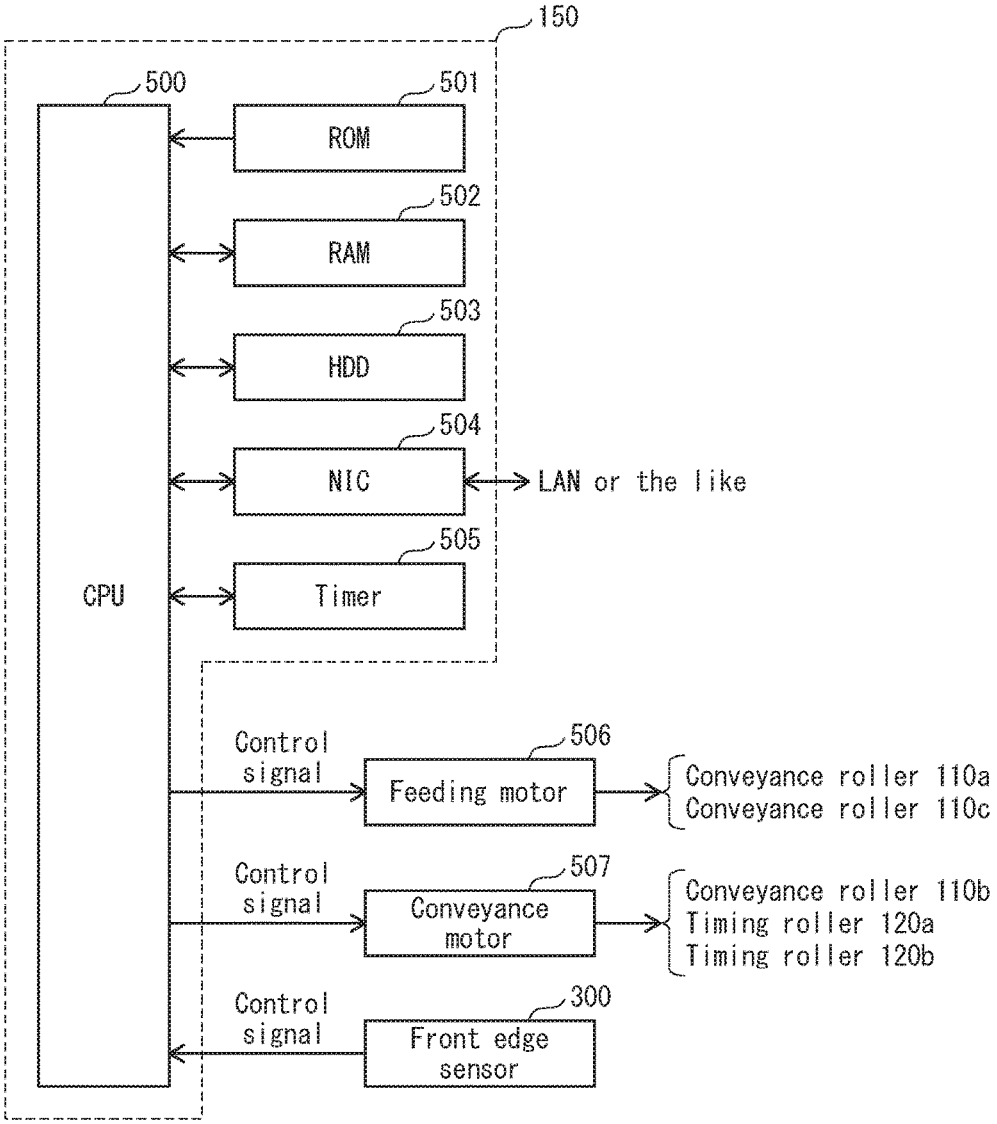
FIG. 5 is a block diagram showing components of a controller 150.

As shown in FIG. 5, the controller 150 includes a central processing unit (CPU) 500, a read only memory (ROM) 501, a random access memory (RAM) 502, and so on. Upon power-on of the image forming device 1, the CPU 500 reads a boot program from the ROM 501 to start up. Then, the CPU 500 executes an operating system (OS), a control program, and so on read from a hard disk drive (HDD) 503, with use of the RAM 502 as a storage region for work.

Upon receiving a print job from an external device such as a personal computer (PC) via a local area network (LAN) or the like with use of a network interface card (NIC) 504, the CPU 500 controls units included in the image forming device 1 to perform image forming processing. In the image forming processing, the CPU 500 inputs a control signal to a feeding motor 506 so as to drive the conveyance rollers 110*a* and 110*c* to rotate, and also inputs a control signal to a feeding motor 507 so as to drive the conveyance roller 110*b* and the timing rollers 120*a* and 120*b* to rotate.

Further, the CPU 500 receives a sensing signal notifying of sensing status of the front edge of each sheet which is input from the front edge sensor 300. Upon sensing of the front edge of the sheet by the front edge sensor 300, the CPU 500 refers to a timer 505 to record a sensing time of the front edge of the sheet in the RAM 502.

Figure 6:
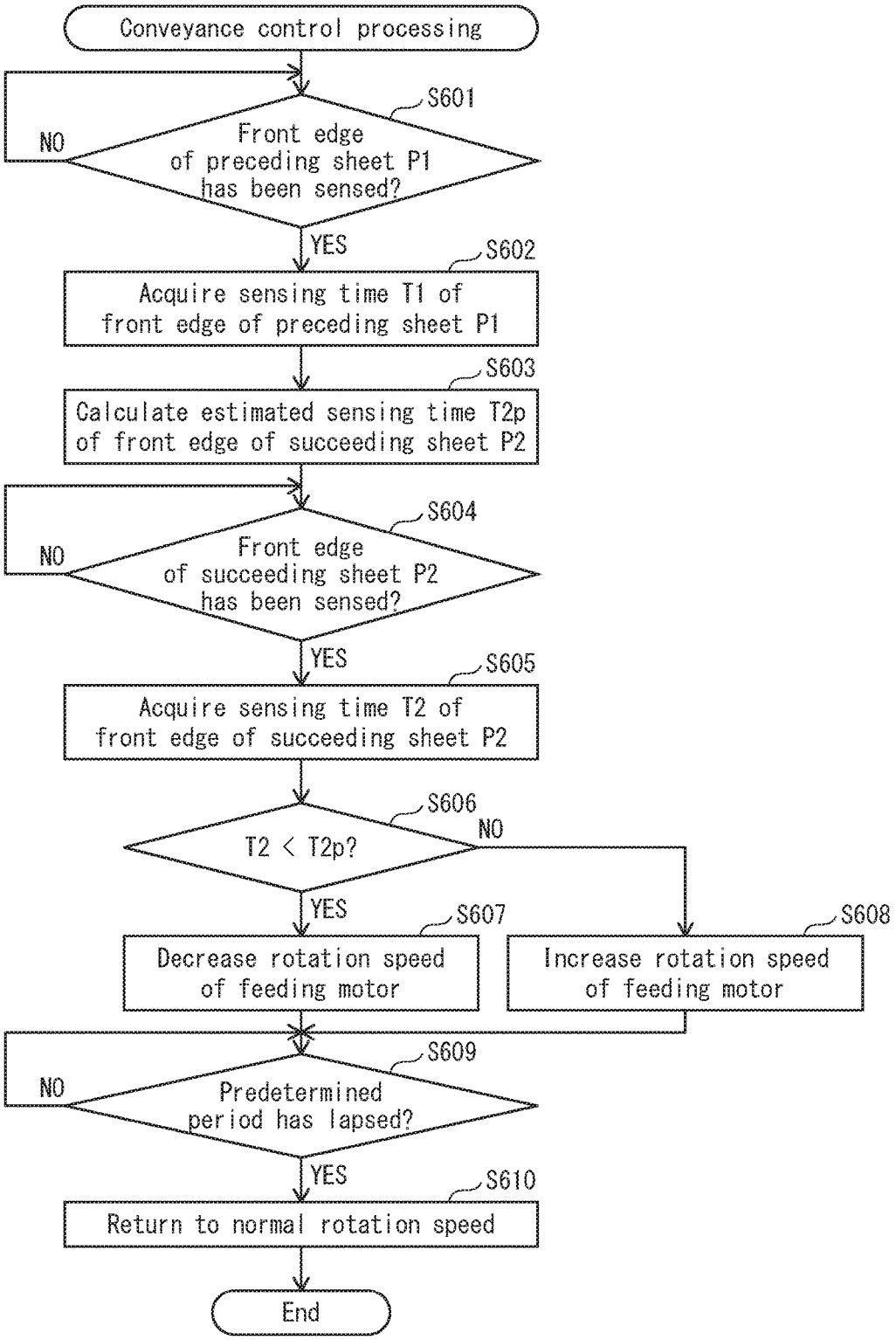
FIG. 6 is a flow chart showing operations of the controller 150.

As shown in FIG. 6, upon receiving a sensing signal indicating that the front edge of a preceding sheet P1 has been sensed from the front edge sensor 300 (S601: YES), the controller 150 refers to the timer 505 to acquire a sensing time T1 of the front edge of the preceding sheet P1 (S602). The controller 150 calculates, as an estimated sensing time T2*p* of the front edge of a succeeding sheet P2, a time after a lapse of a predetermined time difference ΔT since the sensing time T1 of the front edge of the preceding sheet P1 (S603):

$$(T2p=T1+\Delta T).$$

Figure 7A:
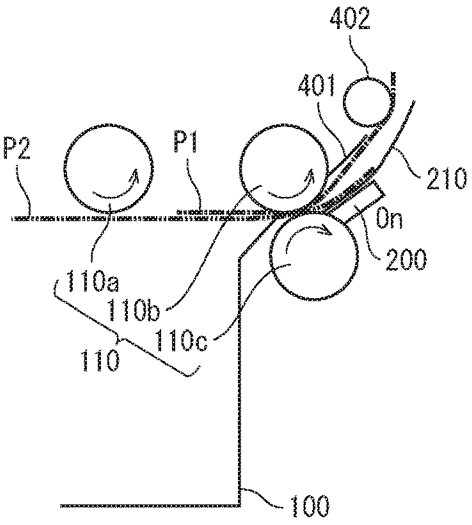
FIGS. 7A to 7C explain control of adjusting an excessively long overlap between the rear edge of the preceding sheet P1 and the front edge of the succeeding sheet P2.
Figure 7B:
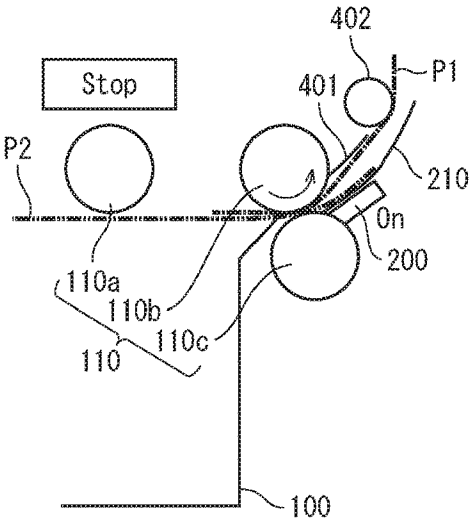

Then, upon receiving a sensing signal indicating that the front edge of a succeeding sheet P2 has been sensed from the front edge sensor 300 (S604: YES), the controller 150 refers to the timer 505 to acquire a sensing time T2 of the front edge of the succeeding sheet P2 (S605). In the case where the sensing time T2 of the front edge of the succeeding sheet P2 is earlier than the estimated sensing time T2*p* (S606: YES), the controller 150 determines that an overlap between the preceding sheet P1 and the succeeding sheet P2 is excessively long (FIG. 7A), and thus decreases the rotation speed of the feeding motor 506 (S607) to stop the feeding motor 506 for a predetermined period (FIG. 7B).

Figure 7C:
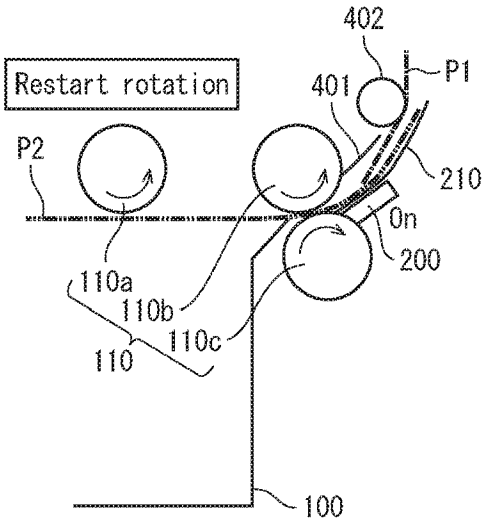

With this configuration, while the rotation speed of the conveyance roller 110*b* and the timing rollers 120*a* and 120*b* is maintained without variation, the rotation of the conveyance rollers 110*a* and 110*c* is stopped. Accordingly, while conveyance of the preceding sheet P1 continues, conveyance of the succeeding sheet P2 stops. This reduces the overlap between the preceding sheet P1 and the succeeding sheet P2, and results in an appropriate interval between the preceding sheet P1 and the succeeding sheet P2. When the predetermined period has lapsed (S609: YES), the controller 150 returns the rotation speed of the feeding motor 506 to the normal rotation speed (S610), and then ends the processing (FIG. 7C).

Figure 8A:
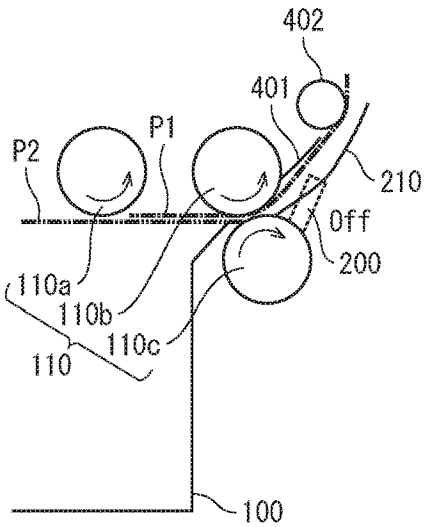
FIGS. 8A to 8C explain control of adjusting an excessively short overlap between the rear edge of the preceding sheet P1 and the front edge of the succeeding sheet P2.
Figure 8B:
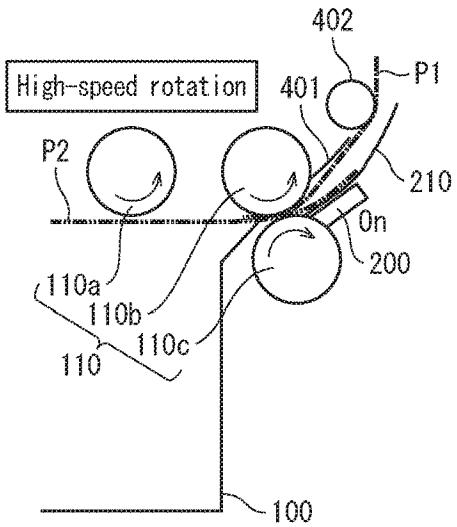
Figure 8C:
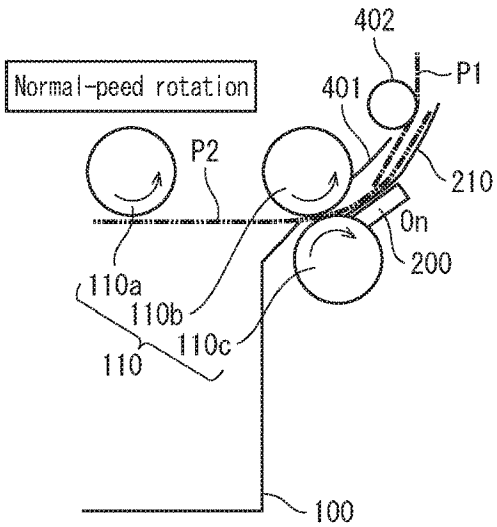

Meanwhile, in the case where the sensing time T2 of the front edge of the succeeding sheet P2 coincides with or is later than the estimated sensing time T2*p* (S606: NO), the controller 150 determines that the overlap between the preceding sheet P1 and the succeeding sheet P2 is excessively short (FIG. 8A), and thus increases the rotation speed of the feeding motor 506 (S608) to rotate the feeding motor 506 at a high rotation speed for a predetermined period (FIG. 8B). With this configuration, the conveyance speed for only the succeeding sheet P2 is increased. This increases the overlap between the preceding sheet P1 and the succeeding sheet P2, and results in an appropriate interval therebetween. When the predetermined period has lapsed (S609: YES), the controller 150 returns the rotation speed of the feeding motor 506 to the normal rotation speed (S610), and then ends the processing (FIG. 8C).

Note that instead of stopping the feeding motor 506, the controller 150 may rotate the feeding motor 506 at a lower rotation speed than the normal rotation speed or rotate backwards as necessary.

[2] Second Embodiment

An image forming device relating to a second embodiment of the present invention has basically the same configuration as the image forming device 1 relating to the above first embodiment, and differs from that of the above first embodiment in terms of configuration for retracting the preceding sheet P1 to be fallen outside the sensing range of the front edge sensor 300. The following description mainly focuses on the difference. Note that members and the like that are common to the embodiments have the common numeric references.

Figure 9:
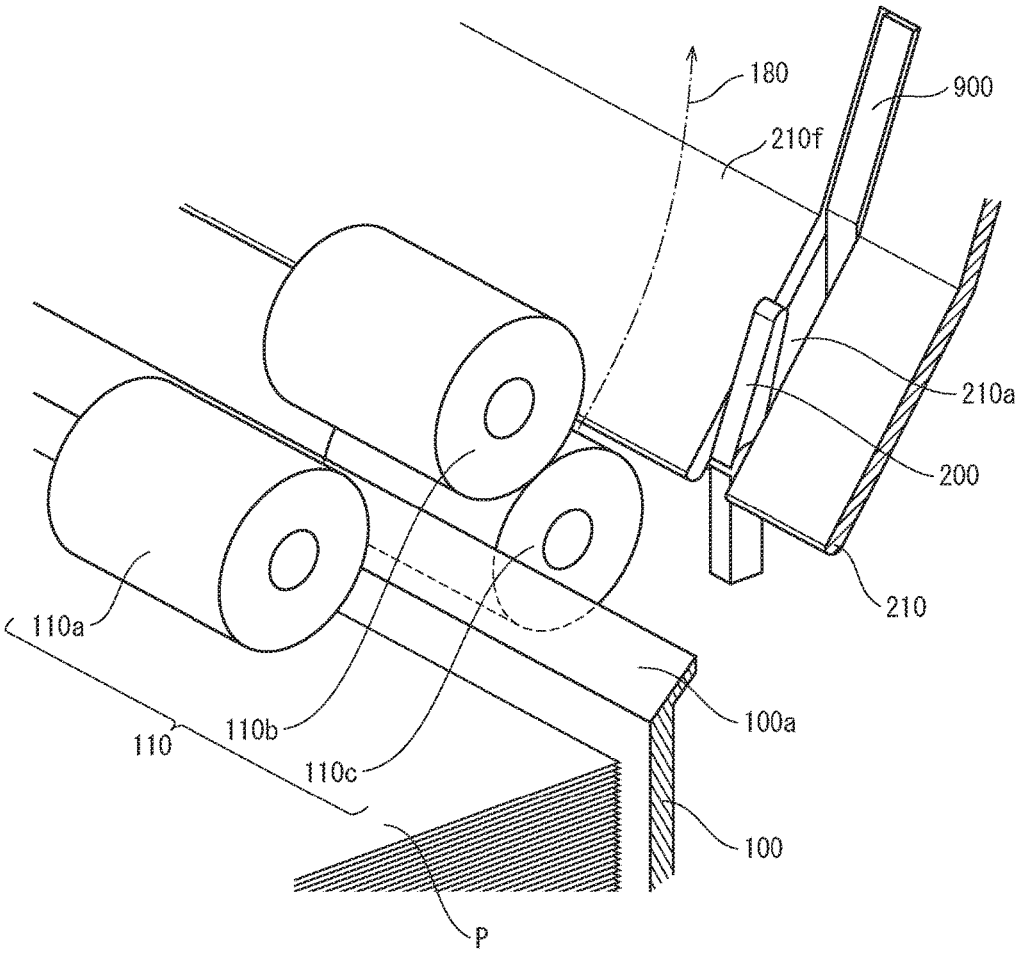
FIG. 9 is a cross-sectional perspective view of a first conveyer and the front edge sensor relating to a second embodiment of the present invention.

As shown in FIG. 9, a conveyance guide 210 has attached thereto a pressing member 900 that is swingable. The pressing member 900 presses a preceding sheet P1 such that the preceding sheet P1 retracts to fall outside a sensing range of a front edge sensor 300.

Figure 10A:
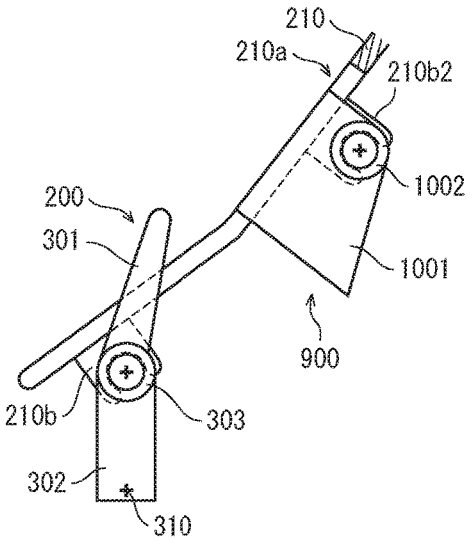
FIGS. 10A to 10D show a pressing member 900 during standby, sensing, retraction, and standby after retraction, respectively.

As shown in FIG. 10A, the pressing member 900 is constituted from a pressing part 1001 and a shaft 1002. On a surface of the conveyance guide 210 opposite to the guide surface 210*f*, a bearing 210*b*2 is integrally formed together with the conveyance guide 210 to support the shaft 1002 of the pressing member 900. This allows the pressing part 1001 to swing around the shaft 1002 to protrude from and recede from the guide surface 210*f*.

The controller 150 controls a motor (not illustrated) to drive the pressing member 900 to swing. While the preceding sheet P1 has not yet entered the swinging range of the actuator 200 (the sensing range of the front edge sensor 300), the pressing part 1001 is in a standby orientation where the pressing part 1001 does not protrude from the guide surface 210*f*.

Figure 10B:
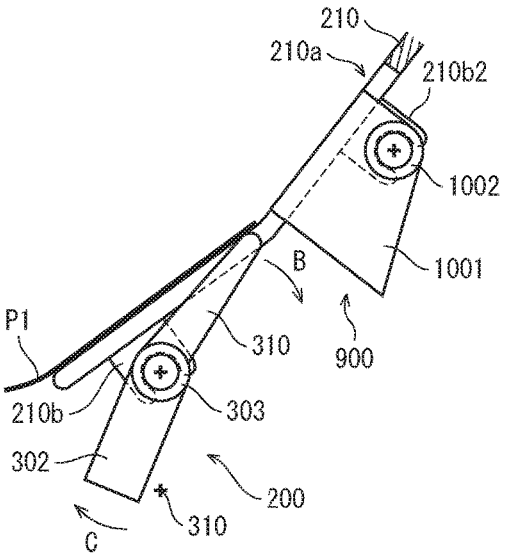
Figure 11:
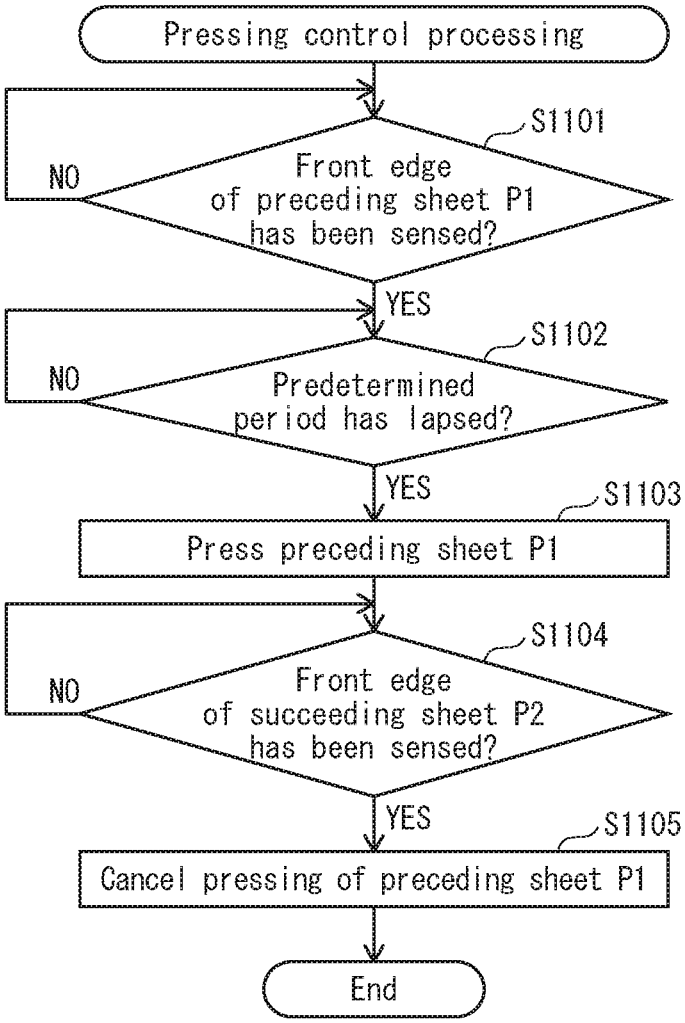
FIG. 11 is a flow chart showing operations of a controller 150.

As shown in FIG. 11, when the actuator 200 is pushed down by the front edge of the preceding sheet P1 (FIG. 10B) and the front edge sensor 300 accordingly senses the front edge of the preceding sheet P1 (S1101: YES), the controller 150 sets a timer 505 for a predetermined period. Then, the controller 150 keeps the pressing member 900 in the standby orientation until the predetermined period has lapsed.

Figure 10C:
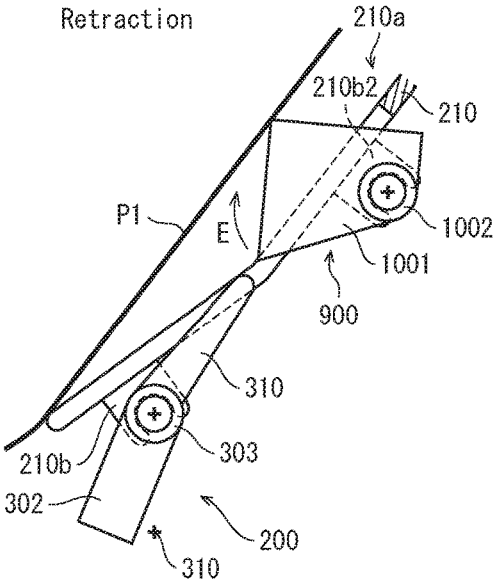
Figure 10D:
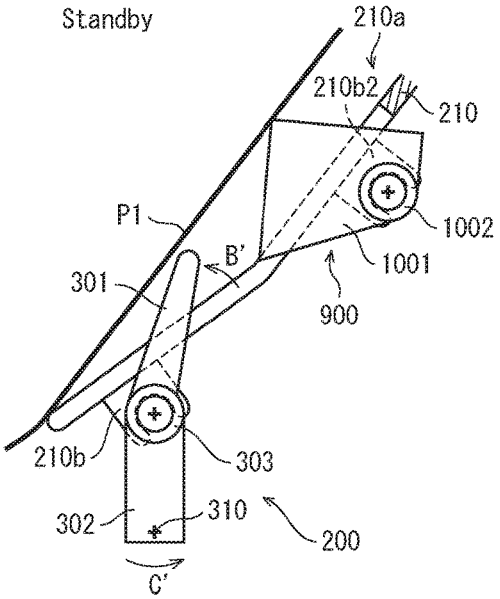

When the predetermined period set in the timer 505 has lapsed (S1102: YES), the controller 150 controls the pressing member 900 to swing in a direction indicated by an arrow E to change to a pressing orientation as shown in FIG. 10C (S1103). Then, the pressing part 1001 presses the preceding sheet P1 outside the swinging range of the actuator 200. Furthermore, as shown in FIG. 10D, an arm part 301 swings in a direction indicated by an arrow B' and a light shielding part 302 swings in a direction indicated by an arrow C', and thus the actuator 200 returns to the standby orientation. This allows the front edge sensor 300 to sense the front edge of the succeeding sheet P2.

Then, when the actuator 200 senses the front edge of the succeeding sheet P2 (S1104: YES), the controller 150 controls the pressing member 900 to swing to cancel the pressing orientation (S1105) and restore to the standby position. This allows conveyance of the succeeding sheet P2 and the preceding sheet P1, which overlaps the succeeding sheet P2, along the conveyance guide 210.

Note that the conveyance speed V1 of the first conveyer 110 and the conveyance speed V2 of the second conveyer 120 may be equal to each other or different from each other because the conveyance speeds V1 and V2 need not to be restricted for sensing the front edge of the succeeding sheet P2.

[3] Third Embodiment

An image forming device relating to a third embodiment of the present invention has basically the same configuration as the image forming device 1 relating to the above first embodiment, and differs from that of the above first embodiment in terms of configuration for retracting the front edge sensor 300 such that the preceding sheet P1 falls outside the sensing range.

Figure 12A:
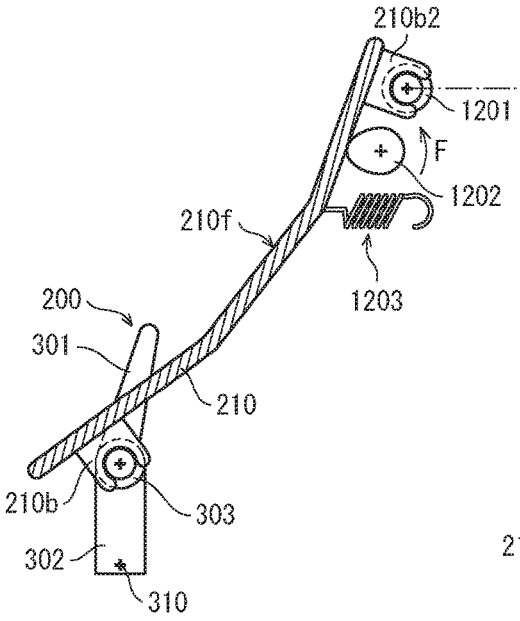
FIGS. 12A and 12B show a conveyance guide 210 during standby and retraction, respectively.
Figure 12B:
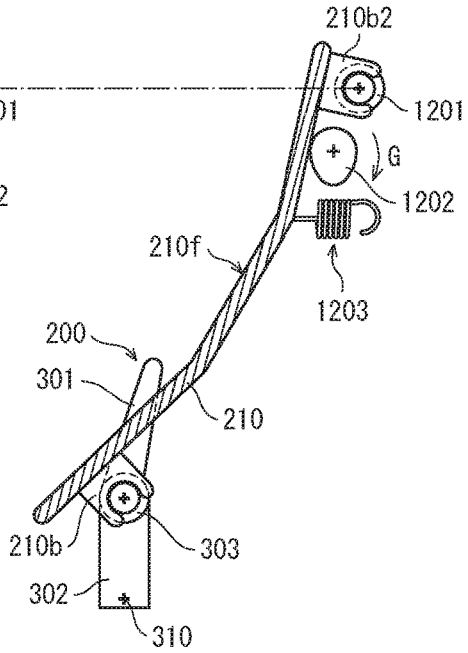
Figure 12C:
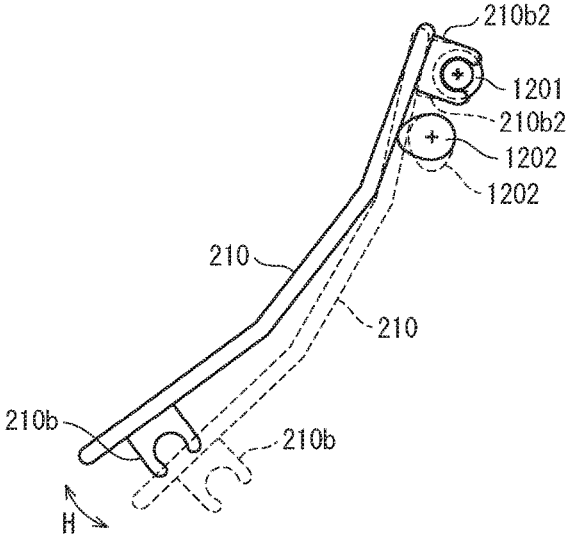
FIG. 12C shows swinging of the conveyance guide 210.

As shown in FIGS. 12A to 12C, a conveyance guide 210 relating to the present embodiment includes a bearing 210*b*2 on a back side of a guide surface 210*f* on the downstream in the sheet conveyance direction. The bearing 210*b*2 supports a swinging shaft 1201. The swinging shaft 1201 is fixed to a body of the image forming device 1. The conveyance guide 210 swings a swinging end thereof to swing in a direction indicated by an arrow H around the swinging shaft 1201 (FIG. 12C).

The conveyance guide 210 is towed by the action of elasticity of a spring 1203 towards the back side of the guide surface 210*f*, and thus swings in accordance with rotation of a cam 1202 that is in contact with the back side of the guide surface 210*f*. FIG. 12A shows the conveyance guide 210 in an advancing orientation where its swinging end advances towards the first conveyer 110. While the conveyance guide 210 in the advancing orientation, when the controller 150 rotates the cam 1202 in a direction indicated by an arrow F, the swinging end of the conveyance guide 210 swings in a direction away from the first conveyer 110 and thus the conveyance guide 210 changes to a retraction orientation (FIG. 12B).

Also, while the conveyance guide 210 in the retraction orientation, when the controller 150 rotates the cam 1202 in a direction indicated by an arrow G, the swinging end of the conveyance guide 210 swings in a direction closer to the first conveyer 110 and thus the conveyance guide 210 changes to the advancing orientation (FIG. 12A). The actuator 200 swings in accordance with swinging of the conveyance guide 210 because of having a cylindrical shaft 303 supported by a bearing 210*b* of the conveyance guide 210.

Figure 13:
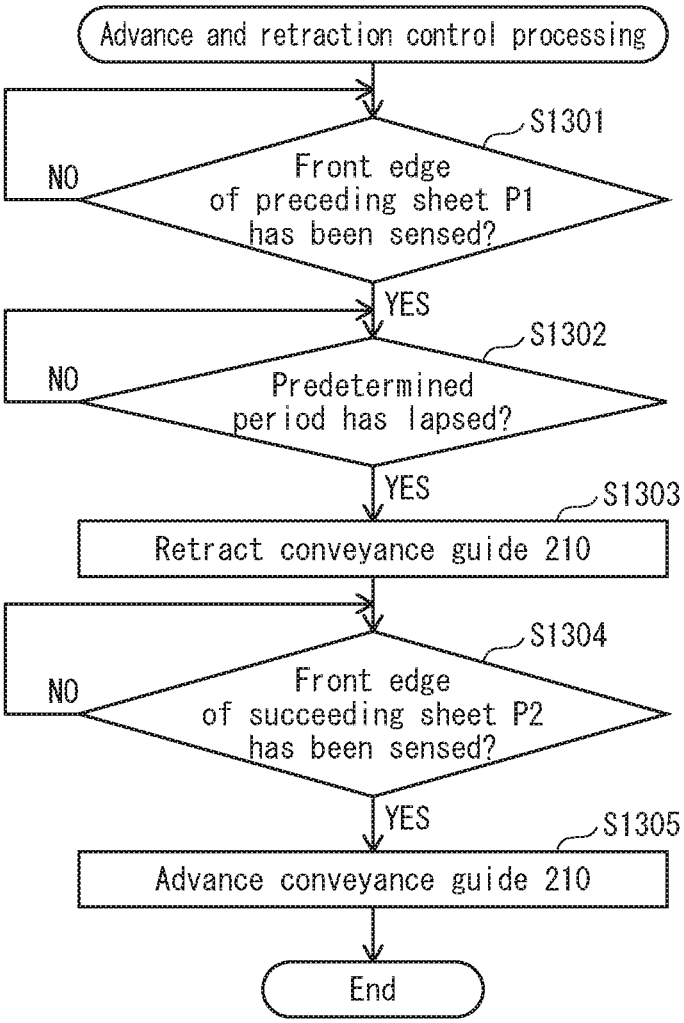
FIG. 13 is a flow chart showing advance and retraction control processing by the controller 150.
Figure 14A:
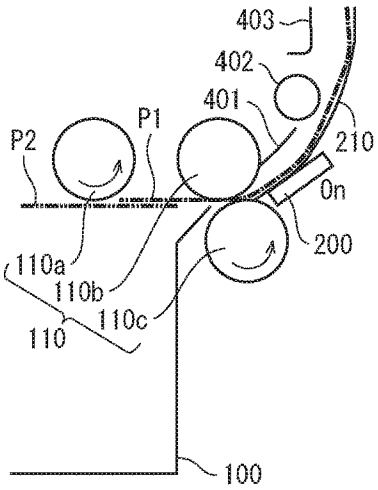
FIGS. 14A to 14D show a preceding sheet P1, a succeeding sheet P2 and the conveyance guide 210 during sensing of the preceding sheet P1, retraction of the front edge sensor, sensing of the succeeding sheet P2, and cancellation of the retraction, respectively.

With this configuration, as shown in FIG. 13, when the front edge sensor 300 senses the front edge of the preceding sheet P1 (S1301: YES), the controller 150 sets a timer 505 for a predetermined period while continuously conveying the preceding sheet P1 (FIG. 14A). When the predetermined period set in the timer 505 has lapsed (S1302: YES), the controller 150 determines that the front edge of the preceding sheet P1 has been caught by the conveyance nip between the timing rollers 120*a* and 120*b*, which constitute the second conveyer 120, and thus controls the conveyance guide 210 to swing to change from the advancing orientation to the retraction orientation (S1303).

Figure 14B:
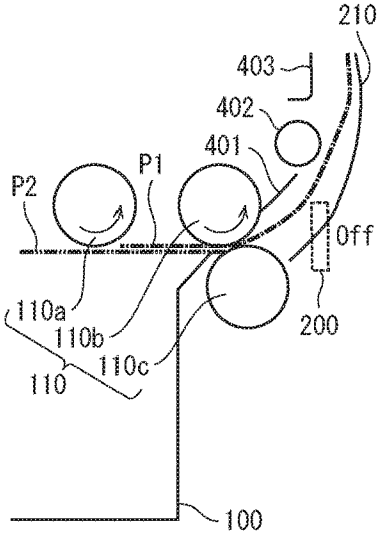

Thus, the conveyance guide 210 swings such that the actuator 200 retracts from the preceding sheet P1, and as a result, the preceding sheet P1 retracts to fall outside the sensing range of the front edge sensor 300. At this time, since the front edge of the preceding sheet P1 has been caught by the conveyance nip of the second conveyer 120, the preceding sheet P1 does not deform though the conveyance guide 210 has retracted (FIG. 14B).

Figure 14C:
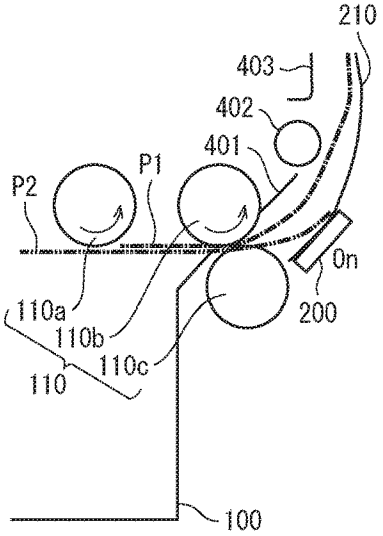
Figure 14D:
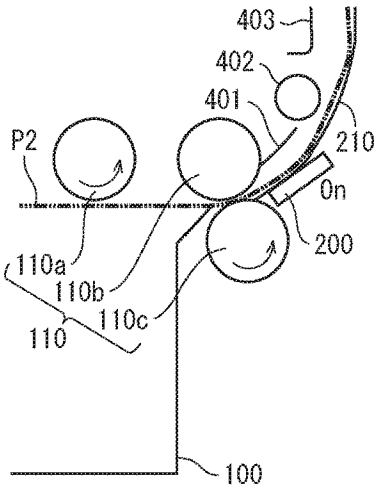

Then, as shown in FIG. 14C, when the front edge sensor 300 senses the front edge of the succeeding sheet P2 (S1304: YES), the controller 150 controls the conveyance guide 210 to swing to return from the retraction orientation to the advancing orientation (S1305). This allows conveyance of the succeeding sheet P2 to the second conveyer 120 along the guide surface 210*f* of the conveyance guide 210 (FIG. 14D).

Even with this configuration, it is possible to sense the front edge of the succeeding sheet P2 with a high precision.

Note that the conveyance guide 210 may be pressed to retract the preceding sheet P1 to be fallen outside the sensing range of the front edge sensor 300, instead of swinging the conveyance guide 210.

[4] Modifications

Above, the present invention is described based on the embodiments, but the present invention is of course not limited to the embodiments above, and the following modifications of the present invention may be implemented.

(4-1) Although no particular reference has been made in the above embodiments, the following modification allows to obtain an overlap distance r between the rear edge of the preceding sheet P1 and the front edge of the succeeding sheet P2 on the conveyance path 180 (an overlap length between the preceding sheet P1 and the succeeding sheet P2) at the start of conveyance of the succeeding sheet P2 by the conveyance roller 110*a*.

Figure 15:
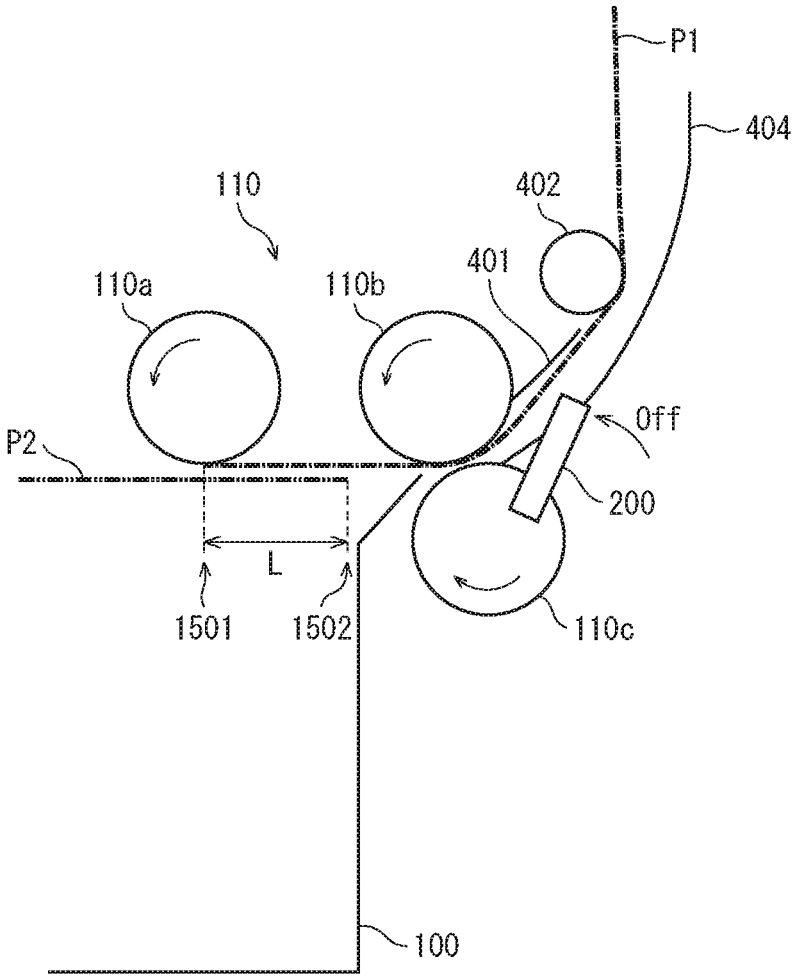
FIG. 15 shows configuration of a first conveyer 110 relating to a modification.

As shown in FIG. 15, the rear edge of the preceding sheet P1 passes through a contact position 1501 where the conveyance roller 110*a* is in contact with each sheet, and at the same time the conveyance roller 110*a* comes into contact with the succeeding sheet P2 to start conveying the succeeding sheet P2. Accordingly, the distance between the rear edge of the preceding sheet P1 and the front edge of the succeeding sheet P2 at the start of conveyance of the succeeding sheet P2 is equal to a distance L between a position 1502 of the front edge of the succeeding sheet P2 before conveyance and the contact position 1501 of the conveyance roller 110*a*.

Thus, to obtain the overlap length r between the preceding sheet P1 and the succeeding sheet P2, the conveyance rollers 110*a*, 110*b*, and 110*c* should be disposed such that the distance L, between the position 1502 of the front edge of the succeeding sheet P2 before conveyance and the contact position 1501 of the conveyance roller 110*a*, equals the overlap length r.

In the case where the distance L is difficult to equal the overlap length r in view of the structure of the image forming device 1, or in the case where a demand arises for a various overlap length r according to image forming conditions, rotation of the conveyance roller 110*a* should be suspended at the same time when the preceding sheet P1 passes through the contact position 1501 of the conveyance roller 110*a*, and should be resumed after lapse of a suspension period Tstop. The suspension period Tstop is obtained as shown in Math (3) below, where V1 expresses the conveyance speed of the conveyance roller 110*a*.

$$Tstop=(L-r)/V1 \quad (3)$$

(4-2) Although no particular reference has been made in the above embodiments, the following problem occurs in the case where only the preceding sheet P1 is conveyed with no feeding of the succeeding sheet P2 due to slip or the like of the first conveyer 110. In such a case, after the rear edge of the preceding sheet P1 passes through the conveyance nip between the conveyance rollers 110*b* and 110*c* of the first conveyer 110, the preceding sheet P1 becomes no longer pulled between the first conveyer 110 and the second conveyer 120-. This cancels retraction of the preceding sheet P1 outside the sensing range of the front edge sensor 300. Then, since the preceding sheet P1 tries to restore from a curved state to a flat state by the action of its rigidity, the rear edge thereof pushes down the actuator 200. As a result, the front edge sensor 300 might perform erroneous sensing.

In response to this problem, an image forming device relating to the present modification includes a sheet sensor 1600 such as shown in FIGS. 16A to 16E. The sheet sensor 1600 includes an actuator like the front edge sensor 300. While the preceding sheet P1 is conveyed along the guide surface 210*f* of the conveyance guide 210, the preceding sheet P1 falls outside a swinging range (sensing range) of the actuator included in the sheet sensor 1600. Thus, the sheet sensor 1600 does not sense the preceding sheet P1. Meanwhile, while the preceding sheet P1 retracts to fall outside the swinging range of the actuator 200, the preceding sheet P1 enters the swinging range (sensing range) of the actuator included in the sheet sensor 1600. Thus, the sheet sensor 1600 senses the preceding sheet P1.

Figure 16A:
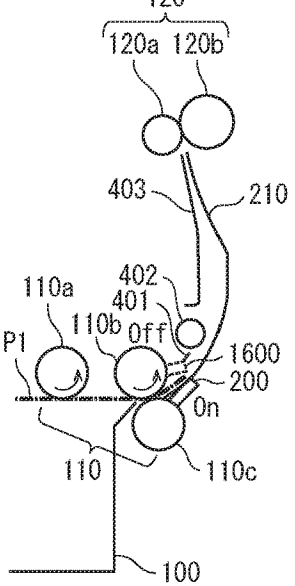
FIGS. 16A to 16E explain a preceding sheet P1, a succeeding sheet P2 and a sheet sensor 1600 relating to a modification.
Figure 17:
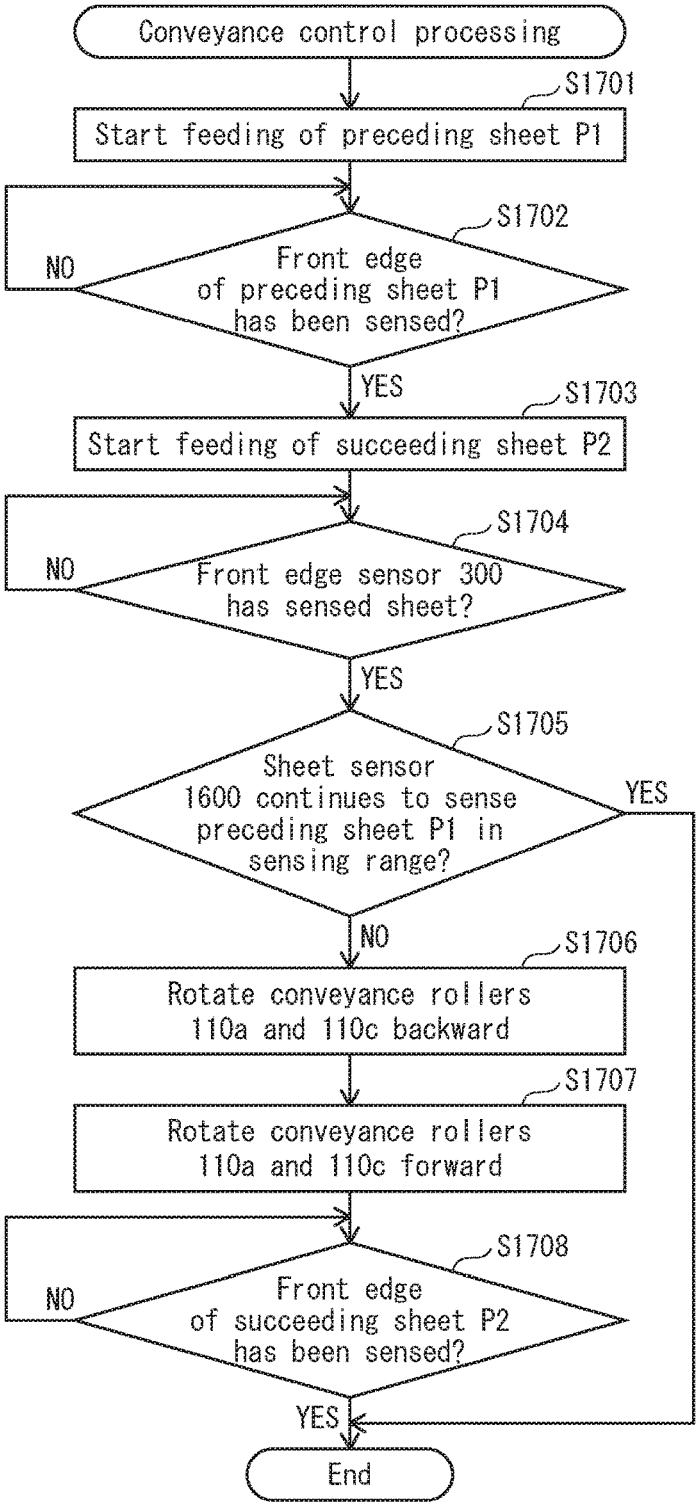
FIG. 17 is a flow chart showing conveyance control processing by a controller 150 relating to the modification.

In the image forming device including the sheet sensor 1600 with this configuration, the controller 150 performs conveyance control processing as shown in FIG. 17. The controller 150 starts feeding the preceding sheet P1 (S1701), and the preceding sheet P1 is conveyed along the conveyance guide 210. Accordingly, the sheet sensor 1600 does not sense the preceding sheet P1, and the front edge sensor 300 senses the front edge of 300 of the preceding sheet P1 (FIG. 16A).

Figure 16B:
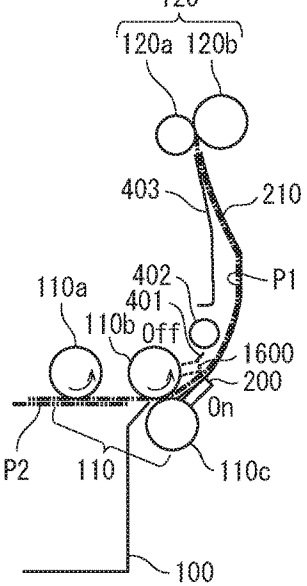

Even after sensing of the front edge of the preceding sheet P1 by the front edge sensor 300, the preceding sheet P1 is further conveyed along the conveyance guide 210 towards the second conveyer 120 (FIG. 16B).

Figure 16C:
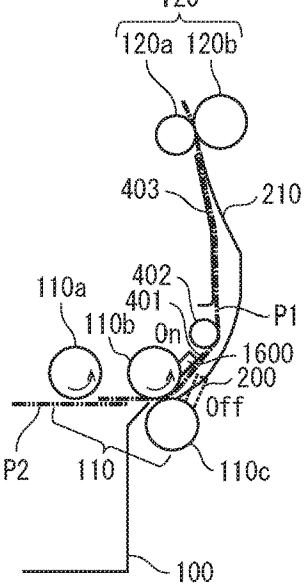
Figure 16D:
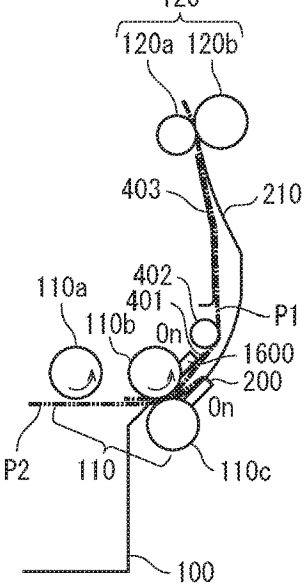

When the front edge of the preceding sheet P1 is caught by the conveyance nip of the second conveyer 120, the preceding sheet P1 is pulled between the first conveyer 110 and the second conveyer 120 because the second conveyer 120 is higher in conveyance speed than the first conveyer 110. As a result, the preceding sheet P1 retracts to fall outside the sensing range of the front edge sensor 300, and pushes down the actuator included in the sheet sensor 1600. This allows the sheet sensor 1600 to sense the preceding sheet P1 (FIG. 16C).

When the sheet sensor 1600 senses the preceding sheet P1 (S1702: YES), the controller 150 determines that the preceding sheet P1 has retracted to fall outside the sensing range of the front edge sensor 300 and this allows the front edge sensor 300 to sense the front edge of the succeeding sheet P2. Thus, the controller 150 starts feeding the succeeding sheet P2 (S1703).

Then, when the front edge sensor 300 has sensed the front edge of any sheet (S1704: YES), the controller 150 refers to a sensing signal input from the sheet sensor 1600. In the case where the sensing signal indicates that the sheet sensor 1600 continues to sense that the preceding sheet P1 falls within the sensing range (S1705: YES), the controller 150 determines that while the preceding sheet P1 has retracted to fall outside the sensing range of the front edge sensor 300, the front edge sensor 300 has sensed the front edge of the succeeding sheet P2.

Meanwhile, in the case where the sensing signal indicates that the sheet sensor 1600 does not continue to sense that the preceding sheet P1 falls within the sensing range (S1705: NO), the controller 150 determines as follows: the preceding sheet P1 has been conveyed with no feeding of the succeeding sheet P2 due to slip or the like of the first conveyer 110, the rear edge of the preceding sheet P1 has passed through the conveyance nip of the first conveyer 110, and thus the preceding sheet P1 has retracted to fall outside the sensing range of the sheet sensor 1600 and has entered the sensing range of the front edge sensor 300, and thus the front edge sensor 300 has sensed the preceding sheet P1.

In this way, when determining that erroneous sensing has occurred and the front edge of the succeeding sheet P2 has not been normally sensed, the controller 150 controls the conveyance rollers 110*a* and 110*c* to rotate backward once (S1706) and then rotate forward (S1707). This cancels the slip or the like of the first conveyer 110, and thus allows the front edge sensor 300 to normally sense the front edge of the succeeding sheet P2.

Figure 16E:
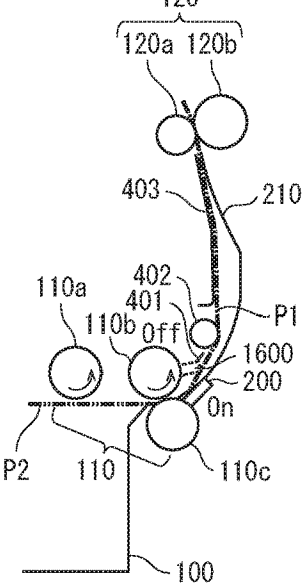

In the case where Step S1705 results in YES or in the case where the front edge sensor 300 senses the front edge of the succeeding sheet P2 (S1708: YES) after Step S1707, the controller 150 adjusts the conveyance timing of the succeeding sheet P2 like in the above first embodiment. In other words, the controller 150 controls the conveyance speed of the first conveyer 110 such that the overlap length between the preceding sheet P1 and the succeeding sheet P2 equals a predetermined value. When the overlap length equals the predetermined value, the controller 150 controls the first conveyer 110 to rotate normally. As a result, the preceding sheet P1 falls outside the sensing range of the sheet sensor 1600 (FIG. 16E).

The above configuration allows precise and stable feeding of the preceding sheet P1 and the succeeding sheet P2 that overlap one another.

(4-3) In the above embodiments, the above description has been provided taking an example where the front edge sensor 300 is an actuator-type photo sensor. However, the present invention is of course not limited to this, and alternatively the following modification is possible. For example, a sensor including an electric node may be applicable to the front edge sensor 300, instead of the photo sensor. According to this sensor, while the actuator 200 is in the standby state, the electric node is insulated, and when the front edge of a sheet pushes down the actuator 200, the electric node is conducted. Even this configuration achieves the cost reduction compared with conventional arts.

(4-4) In the above embodiments, the above description has been provided taking an example where the first conveyer 110 and the second conveyer 120 differ in conveyance direction from each other. However, the present invention is of course not limited to this, and alternatively the following modification is possible.

Figure 18A:
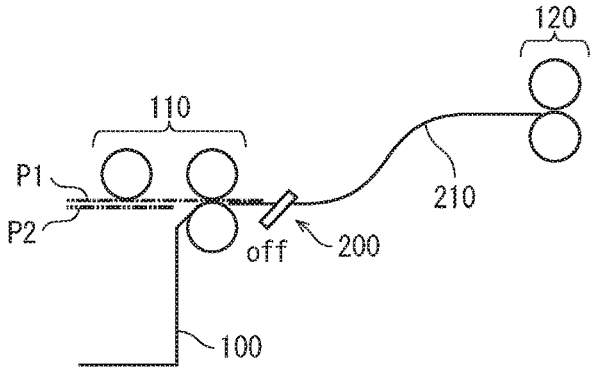
FIGS. 18A to 18D show a preceding sheet P1 and a succeeding sheet P2 that are conveyed in a direction of a first conveyer 110 and a direction of a second conveyer 120 relating to a modification.
Figure 18B:
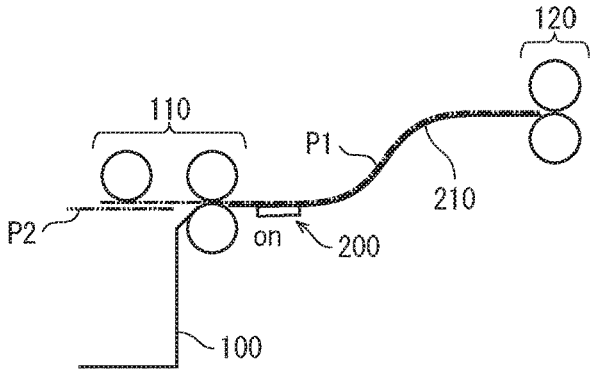

FIGS. 18A to 18D show the first conveyer 110 and the second conveyer 120 whose conveyance directions are parallel to each other. Even in this configuration, the first conveyer 110 picks up the preceding sheet P1 (FIG. 18A), the preceding sheet P1 is conveyed along the conveyance guide 210, and pushes down the actuator 200. This allows the front edge sensor 300 to sense the front edge of the preceding sheet P1 (FIG. 18B).

Figure 18C:
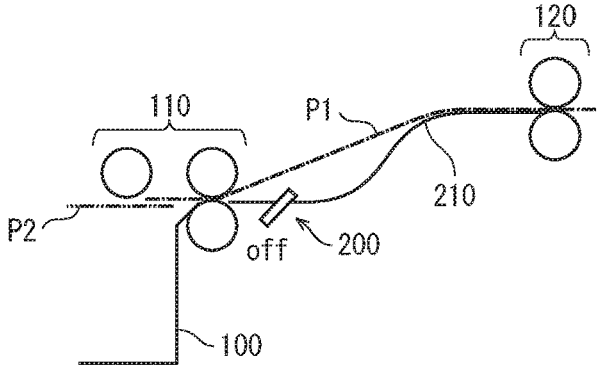
Figure 18D:
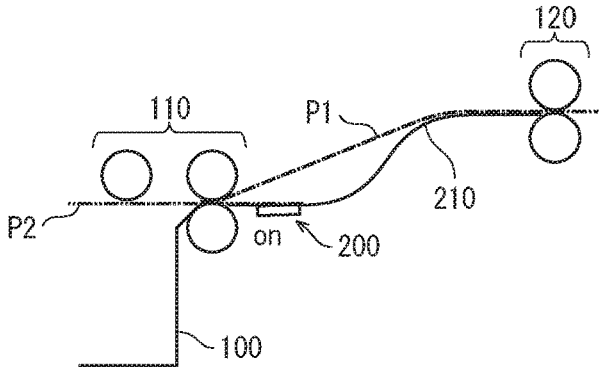

Then, the conveyance speed V2 of the second conveyer 120 is set higher than the conveyance speed V1 of the first conveyer 110 such that the preceding sheet P1 retracts to fall outside the swinging range of the actuator 200. Thus, the actuator 200 returns to the standby orientation, and the front edge sensor 300 accordingly returns to the standby state (FIG. 18C). Then, the first conveyer 110 picks up the succeeding sheet P2, and the front edge of the succeeding sheet P2 pushes down the actuator 200. This allows the front edge sensor 300 to sense the front edge of the succeeding sheet P2 (FIG. 18D).

In the case where the conveyance direction of the second conveyer 120 is on an extension of the conveyance direction of the first conveyer 110, it is impossible to deform the preceding sheet P1 so as to retract to fall outside the swinging range of the actuator 200 even by setting the conveyance speed V2 of the second conveyer 120 higher than the conveyance speed V1 of the first conveyer 110. For this reason, the conveyance direction of the second conveyer 120 should desirably not be an extension of the conveyance direction of the first conveyer 110.

Furthermore, in the case where the conveyance direction of the first conveyer 110 is not parallel to the conveyance direction of the second conveyer 120, the conveyance guide 210 should desirably guide each sheet from the first conveyer 110 to the second conveyer 120 along a desirable conveyance path that is longer than the shortest conveyance path from the first conveyer 110 to the second conveyer 12, such that the front edge of each sheet guided on the desirable conveyance path enters the sensing range of the front edge sensor 300 and the shortest conveyance path is outside the sensing range of the front edge sensor 300.

Moreover, assume a case where the paper cassette 100 is provided in plural in a vertical direction as a paper feeding unit where the first conveyer 110 is provided for each of the paper cassettes 100 and the second conveyer 120 is common to the paper cassettes 100. Even in this case, the conveyance direction of the first conveyer 110 may be parallel to the conveyance direction of the second conveyer 120 as shown in FIGS. 18A to 18D. Furthermore, in this case, the conveyance direction of the first conveyer 110 may be different from each other.

Even this configuration allows to sense a passing time of the front edge of each sheet inexpensively and precisely.

(4-5) In the above embodiments, the above description has been provided taking an example where the image forming device 1 is a tandem-type color MFP. However, the present invention is of course not limited to this, and may be applied to a color MFP of other tandem type or a monochrome MFP. Further, the effects of the present invention can be achieved when applied to a single function peripheral (SFP) such as a printer and a copying device incorporating a scanner, a facsimile device incorporating a facsimile communication function.

[5] Outline

To sum up, the document feeder according to at least one embodiment of the present invention is a document feeder including: a first conveyer that picks up sheets from a sheet bundle sheet by sheet, where a rear edge of a preceding sheet overlaps a front edge of a succeeding sheet; a second conveyer that conveys each sheet picked up by the first conveyer; a front edge sensor that is disposed on a conveyance path from the first conveyer to the second conveyer, and senses whether the sheet falls within a sensing range; and a shift unit that shifts, while the first conveyer and the second conveyer convey the sheet, a positional relation between the sheet and the front edge sensor by increasing a distance therebetween in a direction crossing a sheet conveyance direction, such that the sheet falls outside the sensing range of the front edge sensor, wherein when the preceding sheet falls outside the sensing range, the first conveyer picks up the succeeding sheet such that the front edge of the succeeding sheet enters the sensing range.

With the above configuration, when the preceding sheet falls outside the sensing range of the front edge sensor, the front edge of the succeeding sheet is conveyed so as to enter the sensing range. This allows low-cost and precise sensing of the front edge of the succeeding sheet by a mechanical sensing mechanism. Accordingly, it is possible to precisely control the conveyance positions of the preceding sheet and the succeeding sheet to decrease the interval therebetween, thereby achieving a high productivity.

Also, the first conveyer may pick up each sheet in a first conveyance direction, the second conveyer may convey the sheet in a second conveyance direction that is not an extension of the first conveyance direction, the shift unit may include a conveyance guide that guides the sheet picked up by the first conveyer to the second conveyer along a first conveyance path passing through the sensing range, and after the sheet reaches the second conveyer, the shift unit may shift the positional relation by setting a higher conveyance speed of the second conveyer than a conveyance speed of the first conveyer such that the sheet is conveyed along a second conveyance path, the second conveyance path being shorter than the first conveyance path and not passing through the sensing range.

Also, the shift unit may include a retraction unit that retracts the preceding sheet such that the preceding sheet falls outside the sensing range during a period from sensing of the front edge of the preceding sheet to sensing of the front edge of the succeeding sheet by the front edge sensor.

Also, the retraction unit may be a pressing member that presses each sheet in the direction crossing the sheet conveyance direction.

Also, the shift unit may include: a conveyance guide that guides each sheet from the first conveyer to the second conveyer; and a conveyance guide controller that controls an orientation of the conveyance guide, the conveyance guide may support the front edge sensor, the conveyance guide controller may control the conveyance guide to switch between a first orientation and a second orientation, the conveyance guide in the first orientation may allow the front edge of the preceding sheet to enter the sensing range of the front edge sensor, the conveyance guide in the second orientation may cause the front edge sensor to retract such that the preceding sheet whose front edge has been sensed falls outside the sensing range, when the conveyance guide is in the first orientation and the front edge sensor senses the front edge of the preceding sheet, the conveyance guide controller may control the conveyance guide to switch to the second orientation, and when the conveyance guide is in the second orientation and the front edge sensor senses the front edge of the succeeding sheet, the conveyance guide controller may control the conveyance guide to switch to the first orientation.

Also, the document feeder may further include a controller that controls a conveyance speed of the first conveyer for conveying the succeeding sheet according to a period from sensing of the front edge of the preceding sheet to sensing of the front edge of the succeeding sheet by the front edge sensor.

Also, the controller may control the conveyance speed of the first conveyer for conveying the succeeding sheet such that the front edge of the succeeding sheet protrudes from the first conveyer by a predetermined length.

Also, when the period is shorter than a predetermined period, the controller may control the first conveyer to suspend conveying the succeeding sheet.

Also, when the period is longer than a predetermined period, the controller may increase the conveyance speed of the first conveyer for conveying the succeeding sheet.

Also, the document feeder may further include a shift sensor that senses, after the front edge sensor senses the front edge of the preceding sheet, shift of the positional relation between the preceding sheet and the front edge sensor, wherein after the shift sensor senses the shift, the first conveyer may start picking up the succeeding sheet.

The image forming device according to at least one embodiment of the present invention is an image forming device including a document feeder, the document feeder including: a first conveyer that picks up sheets from a sheet bundle sheet by sheet, where a rear edge of a preceding sheet overlaps a front edge of a succeeding sheet; a second conveyer that conveys each sheet picked up by the first conveyer; a front edge sensor that is disposed on a conveyance path from the first conveyer to the second conveyer, and senses whether the sheet falls within a sensing range; and a shift unit that shifts, while the first conveyer and the second conveyer convey the sheet, a positional relation between the sheet and the front edge sensor by increasing a distance therebetween in a direction crossing a sheet conveyance direction, such that the sheet falls outside the sensing range of the front edge sensor, wherein when the preceding sheet falls outside the sensing range, the first conveyer picks up the succeeding sheet such that the front edge of the succeeding sheet enters the sensing range.

Although embodiments of the present invention have been described and illustrated in detail, the disclosed embodiments are made for purposes of illustration and example only and not limitation. The scope of the present invention should be interpreted by terms of the appended claims.

What is claimed is:

1. A document feeder comprising:

a first conveyer that picks up sheets from a sheet bundle sheet by sheet, and is configured to pick up the sheets such that a rear edge of a preceding sheet overlaps a front edge of a succeeding sheet;

a second conveyer that conveys each sheet picked up by the first conveyer;

a front edge sensor that is disposed on a conveyance path from the first conveyer to the second conveyer, and senses whether the sheet falls within a sensing range; and shifting means for shifting, while the first conveyer and the second conveyer convey a sheet, a positional relation between the sheet and the front edge sensor, by increasing a distance between the sheet and the front edge sensor in a direction crossing a sheet conveyance direction, such that the sheet falls outside the sensing range of the front edge sensor, wherein the shifting means includes retracting means for retracting the preceding sheet such that the preceding sheet falls outside the sensing range during a period from sensing of the front edge of the preceding sheet to sensing of the front edge of the succeeding sheet by the front edge sensor.

2. The document feeder of claim 1, wherein the retracting means comprises a pressing member that presses each sheet in the direction crossing the sheet conveyance direction.

3. An image forming device comprising the document feeder according to claim 1.

4. A document feeder comprising:

a first conveyer that picks up sheets from a sheet bundle sheet by sheet, and is configured to pick up the sheets such that a rear edge of a preceding sheet overlaps a front edge of a succeeding sheet;

a second conveyer that conveys each sheet picked up by the first conveyer;

a front edge sensor that is disposed on a conveyance path from the first conveyer to the second conveyer, and senses whether the sheet falls within a sensing range; and a shift unit that includes:

a conveyance guide that guides each sheet from the first conveyer to the second conveyer; and a conveyance guide controller that controls an orientation of the conveyance guide, wherein:

the conveyance guide supports the front edge sensor, the conveyance guide controller controls the conveyance guide to switch between a first orientation and a second orientation, the conveyance guide in the first orientation allows the front edge of the preceding sheet to enter the sensing range of the front edge sensor, the conveyance guide in the second orientation causes the front edge sensor to retract such that the preceding sheet whose front edge has been sensed falls outside the sensing range, when the conveyance guide is in the first orientation and the front edge sensor senses the front edge of the preceding sheet, the conveyance guide controller controls the conveyance guide to switch to the second orientation, and when the conveyance guide is in the second orientation and the front edge sensor senses the front edge of the succeeding sheet, the conveyance guide controller controls the conveyance guide to switch to the first orientation.

5. An image forming device comprising the document feeder according to claim 4.

6. A document feeder comprising:

a first conveyer that picks up sheets from a sheet bundle sheet by sheet, and is configured to pick up the sheets such that a rear edge of a preceding sheet overlaps a front edge of a succeeding sheet;

a second conveyer that conveys each sheet picked up by the first conveyer;

a front edge sensor that is disposed on a conveyance path from the first conveyer to the second conveyer, and senses whether the sheet falls within a sensing range;

shifting means for shifting, while the first conveyer and the second conveyer convey a sheet, a positional relation between the sheet and the front edge sensor, by increasing a distance between the sheet and the front edge sensor in a direction crossing a sheet conveyance direction, such that the sheet falls outside the sensing range of the front edge sensor; and a controller that controls a conveyance speed of the first conveyer for conveying the succeeding sheet according to a period from sensing of the front edge of the preceding sheet to sensing of the front edge of the succeeding sheet by the front edge sensor.

7. The document feeder of claim 6, wherein the controller controls the conveyance speed of the first conveyer for conveying the succeeding sheet such that the front edge of the succeeding sheet protrudes from the first conveyer by a predetermined length.

8. The document feeder of claim 6, wherein when the period is shorter than a predetermined period, the controller controls the first conveyer to suspend conveying the succeeding sheet.

9. The document feeder of claim 6, wherein when the period is longer than a predetermined period, the controller increases the conveyance speed of the first conveyer for conveying the succeeding sheet.

10. An image forming device comprising the document feeder according to claim 6.

11. A document feeder comprising:

a first conveyer that picks up sheets from a sheet bundle sheet by sheet, and is configured to pick up the sheets such that a rear edge of a preceding sheet overlaps a front edge of a succeeding sheet;

a second conveyer that conveys each sheet picked up by the first conveyer;

a front edge sensor that is disposed on a conveyance path from the first conveyer to the second conveyer, and senses whether the sheet falls within a sensing range;

shifting means for shifting, while the first conveyer and the second conveyer convey a sheet, a positional relation between the sheet and the front edge sensor, by increasing a distance between the sheet and the front edge sensor in a direction crossing a sheet conveyance direction, such that the sheet falls outside the sensing range of the front edge sensor; and a shift sensor that senses, after the front edge sensor senses the front edge of the preceding sheet, shift of the positional relation between the preceding sheet and the front edge sensor, wherein after the shift sensor senses the shift, the first conveyer starts picking up the succeeding sheet.

12. An image forming device comprising the document feeder according to claim 11.

* * * * *